US006775501B2

(12) United States Patent
Kim

(10) Patent No.: US 6,775,501 B2
(45) Date of Patent: Aug. 10, 2004

(54) DEVELOPING APPARATUS FOR LIQUID TYPE PRINTER

(75) Inventor: Wan-ha Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/419,182

(22) Filed: Apr. 21, 2003

(65) Prior Publication Data

US 2004/0009013 A1 Jan. 15, 2004

(30) Foreign Application Priority Data

Jul. 15, 2002 (KR) ..... 2002-41369

(51) Int. Cl.[7] ..... G03G 15/10
(52) U.S. Cl. ..... 399/237; 399/249
(58) Field of Search ..... 399/237, 248, 399/249, 239, 240

(56) References Cited

U.S. PATENT DOCUMENTS 5,943,534 A * 8/1999 Watanabe ..... 399/237
5,999,778 A * 12/1999 Chang et al. ..... 399/237
6,600,884 B2 * 7/2003 Shimmura ..... 399/57
2003/0156857 A1 * 8/2003 Kim ..... 399/237

* cited by examiner

*Primary Examiner*—Quana Grainger
(74) *Attorney, Agent, or Firm*—Staas & Halsey LLP

(57) ABSTRACT

A developing apparatus for a liquid type printer includes a developing tank in which ink with a high density supplied from an ink supplying unit is received up to a predetermined level. The developing apparatus also includes a developing roller which is positioned to rotate in the developing tank and keep a predetermined developing gap from a photosensitive medium, and to supply the ink to the photosensitive medium. The developing apparatus includes a metering unit which is rotated in the ink in the developing tank to control an amount of the ink conveyed to the developing roller and moved to the developing gap, and a cleaning roller which cleans the ink remaining after the ink is conveyed from the developing roller to the photosensitive medium.

16 Claims, 3 Drawing Sheets

DEVELOPING APPARATUS FOR LIQUID TYPE PRINTER

CROSS REFERENCE TO RELATED APPLICATION

This application claims the benefit of Korean Application No. 2002-41369, filed Jul. 15, 2002, in the Korean Intellectual Property Office, the disclosure of which is incorporated herein by reference.

BACKGROUND OF THE INVENTION

1. Field of the Invention

The present invention relates to a developing apparatus for a liquid type printer, and more particularly, to a developing apparatus for a liquid type printer which uses a developer in high concentration.

2. Background of the Related Art

Generally, image forming apparatuses such as laser printers or copiers are classified according to developing types, such as a dry type using a powder toner and a liquid type using a toner mixed in a liquid carrier. These two types develop a predetermined image by supplying a toner to a photosensitive medium such as a photoconductive drum in which an electrostatic latent image is formed. Then, a developed image is printed on paper by passing the paper in between the photoconductive drum and a transferring media rotating in connection with the photoconductive drum. Recently, the liquid developing type has been widely used.

A liquid developing apparatus using toner particles having a size below 0.5~5 $\mu$m has an advantage of getting a high definition image when developing the electrostatic latent image formed on the photosensitive medium.

The liquid developing apparatus obtains an appropriate image density by lowering an ink density of a liquid developer to a lower level, for example, to below about 3%. In order to supply a sufficient amount of developer to a development area and to collect it, a complex system of supplying a developer (such as an ink delivery system) is required and as a result, a volume of a printer becomes bigger and a structure thereof becomes complicated. Also, there is a requirement for a device to control an ink density of the liquid developer required during re-supply of ink due to changes in the toner particles.

FIG. 1 is a schematic diagram of a developing apparatus in a conventional liquid type printer. Referring to FIG. 1, ink with an initial density of about 1.8~2.0% is controlled by a separate density control system (not shown) and then is supplied to a manifold 1*a* through a pump. The supplied ink is conveyed by a deposit bar 1 to a developing roller 2 to a certain thickness. A gap between the deposit bar 1 and the developing roller 2 is about 400 $\mu$m, and the ink passing through the gap is stuck to the developing roller 2 so that the ink density is increased to about 15~7%. Over-supplied ink is removed from the developing roller 2 by a squeegee roller 3. The density of the ink on the developing roller 2 is again increased to about 20%. The ink having such high density is conveyed from the developing roller 2 to an electrostatic latent image area of a photosensitive medium 6. Residual ink on the developing roller 2 is cleaned by a cleaning roller 4, and the ink on the cleaning roller 4 is removed by a sponge roller 5.

In the developing apparatus for the liquid type printer having the above-described construction, the construction of the developing apparatus becomes complicated to obtain the ink with the high density. Furthermore, since an ink feeding system and system to regulate the ink density at the initial value as described above are required, there exists a problem that the printer has to be increased in size and therefore, becomes unsuitable for general office use.

SUMMARY OF THE INVENTION

Accordingly, it is an aspect of the present invention to provide a developing apparatus for a liquid type printer that is improved to control a wrap around.

Additional aspects and advantages of the invention will be set forth in part in the description which follows and, in part, will be obvious from the description, or may be learned by practice of the invention.

The foregoing and/or other aspects of the present invention are achieved by providing a developing apparatus for a liquid type printer. The developing apparatus includes an ink supplying unit to supply ink having a high density, and a developing tank to receive the ink up to a predetermined level. The developing apparatus also includes a developing roller positioned to rotate in the developing tank and keep a predetermined developing gap from a photosensitive medium, and to supply the ink to the photosensitive medium. The developing apparatus includes a metering unit, rotated in the ink in the developing tank to control an amount of the ink conveyed to the developing roller and moved to the developing gap, and a cleaning roller to clean the ink remaining after the ink is conveyed from the developing roller to the photosensitive medium.

According to an aspect of the invention, the metering unit includes a metering roller positioned to rotate in the developing tank at a predetermined metering gap from the developing roller.

According to an aspect of the invention, the density of the ink received in the developing tank is 6~18%.

According to another aspect of the invention, the cleaning roller rotates in the same direction as the developing roller while being connected to the developing roller to pump up the ink in the developing tank to a portion between the developing roller and the metering unit.

According to yet another aspect of the invention, the cleaning roller includes a sponge which includes micro cells below 50 $\mu$m.

According to an aspect of the invention, the developing apparatus includes an ink conveying roller positioned to rotate in the developing tank to convey the ink to a side of the cleaning roller.

According to an aspect of the invention, the cleaning roller is formed with conductive materials to receive an applied voltage from a predetermined power source.

According to an aspect of the invention, the metering unit includes a friction plate, elastically connected to the developing roller, and elastically stressed by a rotary power of the developing roller and the ink, to control an amount of the ink to be regularly supplied to the developing roller.

BRIEF DESCRIPTION OF THE DRAWINGS

The above and/or other aspects and advantages of the invention will become apparent and more appreciated from the following description of the preferred embodiments, taken in conjunction with the accompanying drawings of which.

DETAILED DESCRIPTION OF PREFERRED EMBODIMENTS

Figure 1:
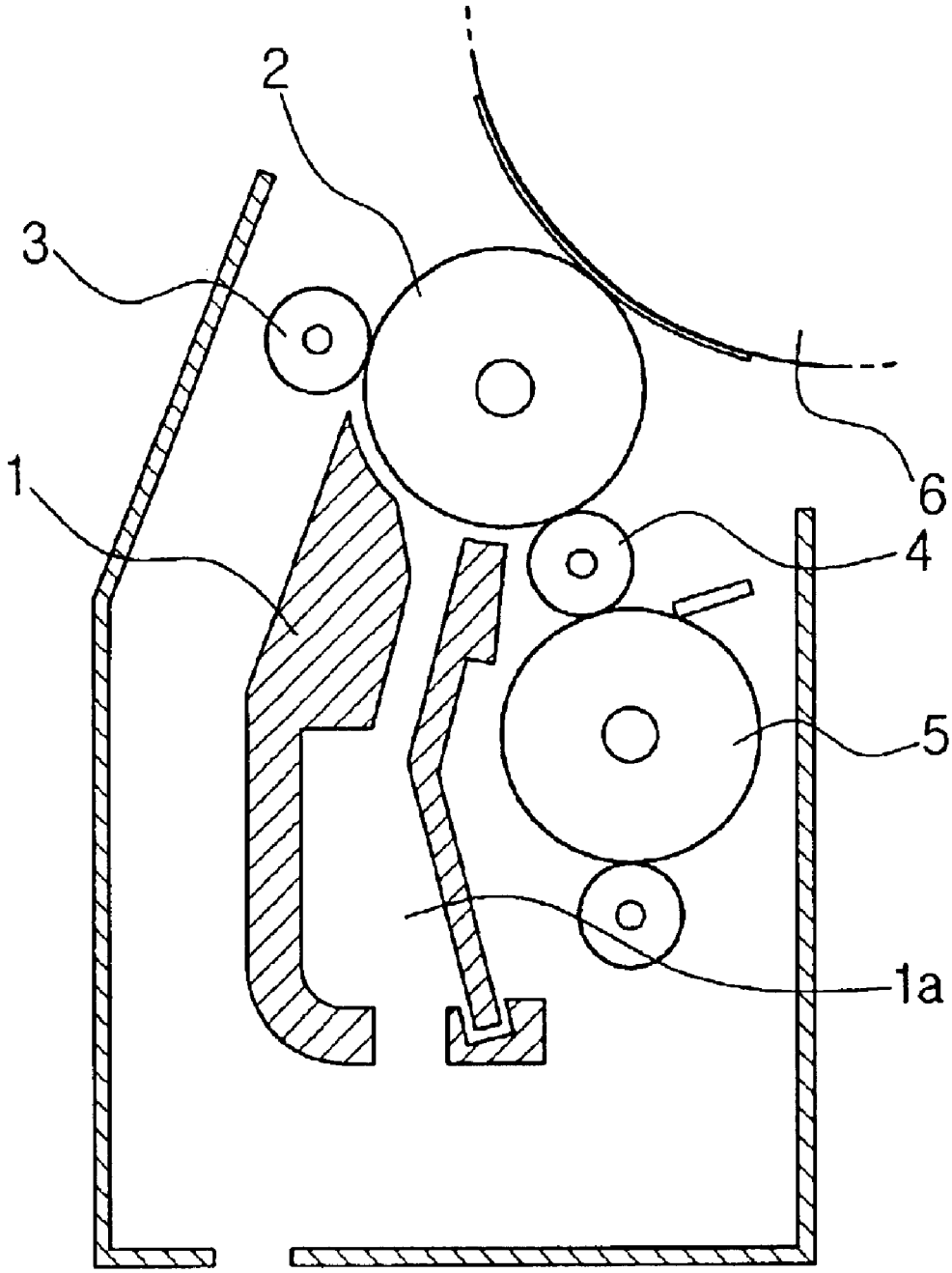
FIG. 1 (PRIOR ART)
FIG. 1 is a schematic diagram of a developing apparatus for a conventional liquid type printer.

Reference will now be made in detail to the present preferred embodiments of the present invention, examples of which are illustrated in the accompanying drawings, wherein like reference numerals refer to like elements throughout.

Figure 2:
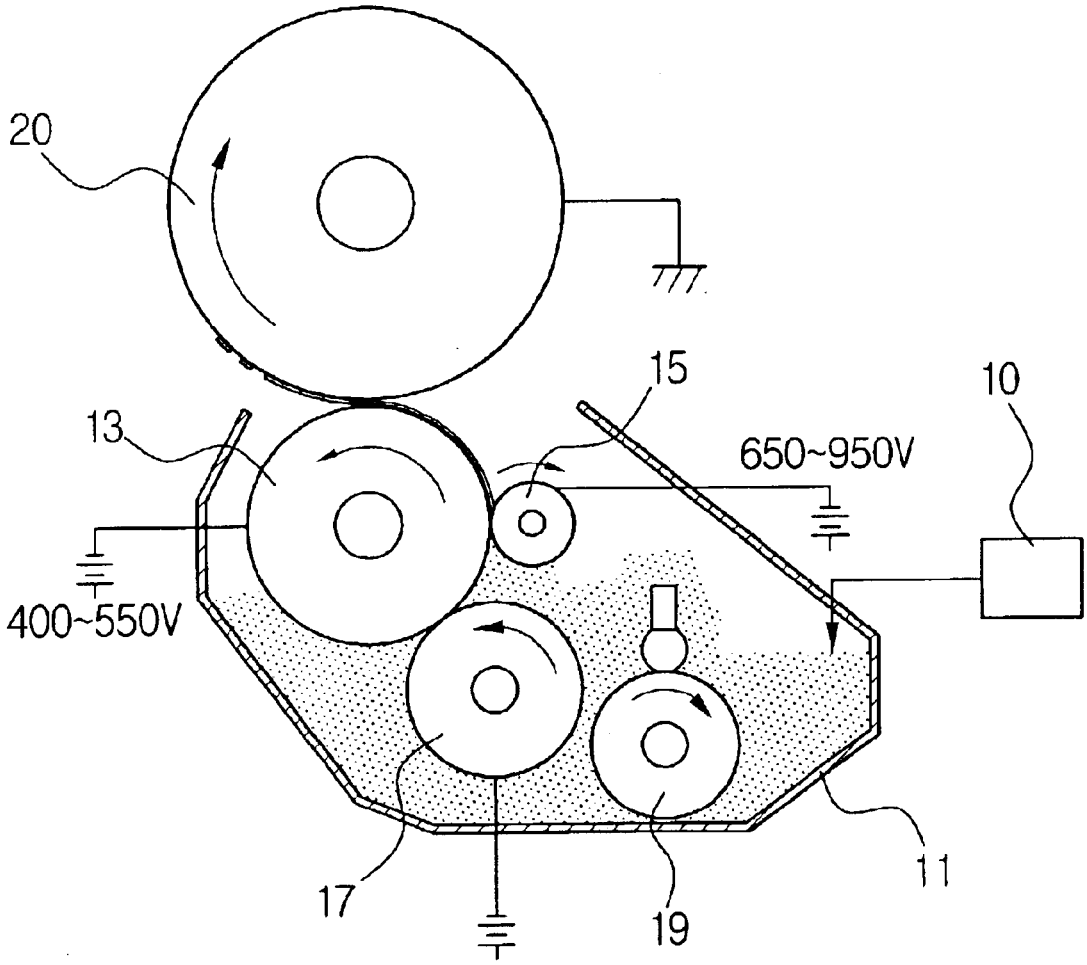
FIG. 2 is a schematic diagram of a developing apparatus for a liquid type printer, according to an embodiment of the present invention.

FIG. 2 is a schematic diagram of a developing apparatus for a liquid type printer, according to an embodiment of the present invention. Referring to FIG. 2, the developing apparatus for the liquid type printer includes a developing tank 11 in which ink having a high density supplied by an ink supplying unit 10 is received up to a predetermined level. The developing apparatus also includes a developing roller 13 positioned to rotate in the developing tank 11, a metering unit to control an amount of the ink conveyed to the developing roller 13 to be constant per unit area, a cleaning roller 17 to clean a residual ink on the developing roller 13, and an ink conveying roller 19 to move the ink to the cleaning roller 17.

The developing tank 11 is positioned at a lower portion of a photosensitive medium 20. The ink supplied and received to the developing tank 11 is a mixture of a liquid carrier and a powder toner, and has a high density of about 6~18%.

The developing roller 13 is positioned to be rotatable in the developing tank 11, and a part of the developing roller 13 is rotated in the ink. The developing roller 13 is also positioned to be rotatable while keeping a predetermined developing gap from the photosensitive medium 20. The developing roller 13 is rotated in a regular direction, and part of the developing roller 13 pumps up the ink to a circumference thereof by its rotational force, so that the ink is supplied to the photosensitive medium 20. In the developing roller 13, a predetermined voltage, for example, a voltage of 400~550V, is applied. As a result, the ink conveyed to the developing roller 13 is transferred to an electrostatic latent image area of the photosensitive medium 20 by a potential difference between the electrostatic latent image area formed on the photosensitive medium 20 and the developing roller 13.

The metering unit includes a metering roller 15 which is positioned to be rotatable at a predetermined metering gap from the developing roller 13. In the metering roller 15, a predetermined electric potential, for example, a potential of 650~950V, is applied. The metering roller 15 controls an amount of the ink so that the ink conveyed to the circumference of the developing roller 13 is supplied in a regular amount per unit area to the developing gap between the developing roller 13 and the photosensitive medium 20. The metering roller 15 controls the amount of the ink on the developing roller 13 to be about 150~200 $\mu g/cm^2$. In this case, up to an ink density of 6%, it is possible to obtain an equal development amount conveyed from the developing roller 13 to the photosensitive medium 20.

The cleaning roller 17 is positioned to be rotatable in the developing tank 11, and is connected to a lower side of the developing roller 17. The cleaning roller 17 is rotated and driven in the ink in the same direction as the developing roller 13 and cleans the ink remaining after the ink has been conveyed from the developing roller 13 to the photosensitive medium 20. Further, the cleaning roller 17 is positioned in close proximity of the metering roller 15 to pump up the ink to the metering gap between the metering roller 15 and the developing roller 13 by a rotational force. The cleaning roller 17 includes a sponge material which includes micro cells below 50 $\mu$m.

In the developing tank 11, an ink conveying roller 19 is positioned to move the received ink to a side of the cleaning roller 17. The ink conveying roller 19 is rotated in the developing tank 11 and pumps the ink up to the side of the cleaning roller 17, so that the ink is smoothly supplied to the metering gap between the metering roller 15 and the developing roller 13 by the cleaning roller 17.

Hereinafter, an operation of the developing apparatus for the liquid type printer having the aforementioned structure will be described.

When the ink is received to a predetermined level in the developing tank 11, the ink conveying roller 19 rotates and supplies the ink to the side of the cleaning roller 17. The cleaning roller 17 rotates in the same direction as the developing roller 13 and pumps up the ink between the developing roller 13 and the metering roller 15. The developing roller 13 rotates and pumps up the ink, by its own rotational force and viscosity of the ink, to be supplied to the metering gap. Thus, a sufficient amount of ink is supplied to the metering gap.

The metering roller 15 rotates, keeping the metering gap from the developing roller 13, and it controls the amount of the ink on the circumference of the developing roller 13 to be regular. Consequently, the ink having a regular thickness and amount is spread equally per unit area on the circumference of the developing roller 13 passing through the metering gap. The ink in a regular amount is conveyed through the developing gap, by a potential difference from the developing roller 13 to the electrostatic latent image area of the photosensitive medium 20. The ink still remaining on the developing roller 13 is removed by the cleaning roller 17.

As described above, to smoothly supply the ink by positioning the cleaning roller 17 in close proximity of the metering roller 15, the same development amount may be obtained up to the ink density of 6%. Therefore, the above-mentioned simple structure makes it possible to obtain a regular amount of ink with a high density, without requiring any complicate devices as required in the conventional developing apparatus.

It is also possible to form the cleaning roller 17 of conductive materials so that a predetermined electric potential may be applied to improve a function of supplying ink to the developing roller 13.

Figure 3:
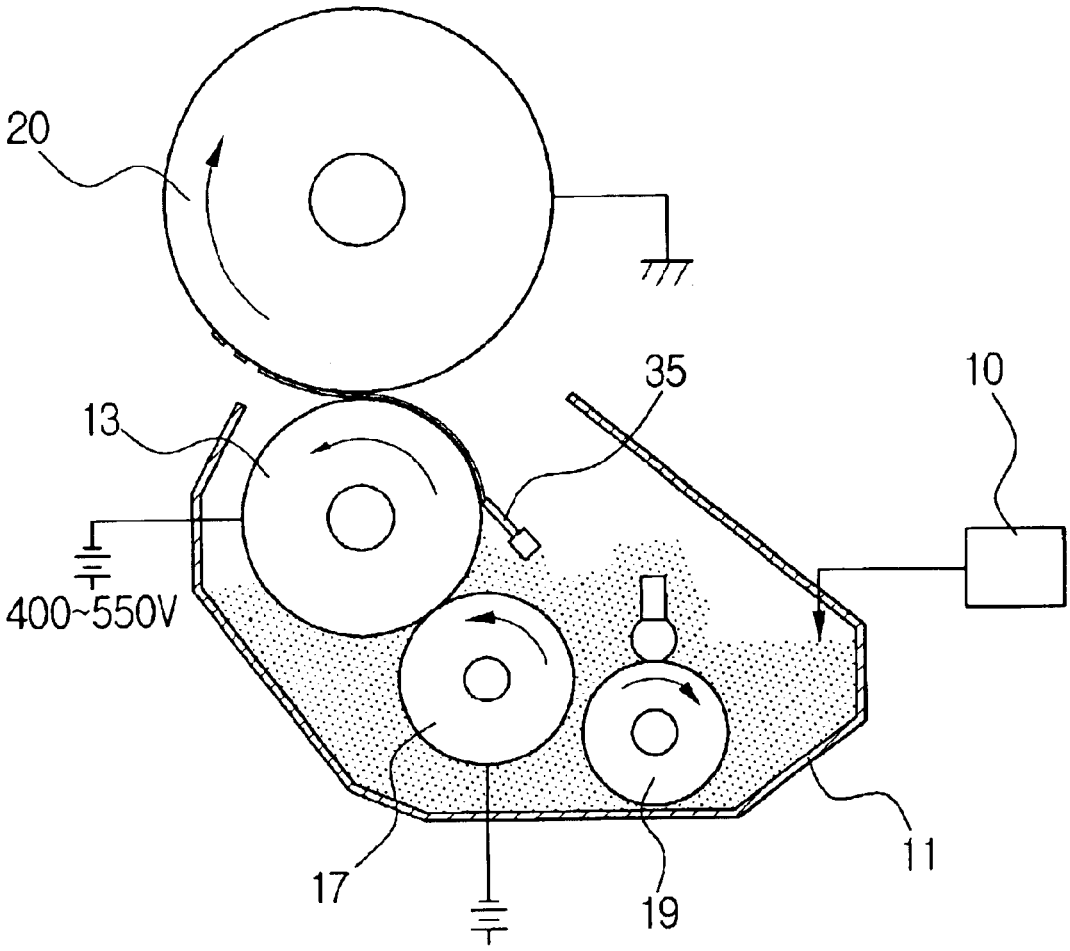
FIG. 3 is a schematic diagram of a developing apparatus for a liquid type printer, according to another embodiment of the present.

Further, as illustrated in FIG. 3, a friction plate 35 which is elastically connected to the developing roller 13 may be adopted as the metering unit. In this case, the friction plate 35 has an elasticity so that it bends even by a little force. Since the friction plate 35 is elastically pushed by the rotational force of the developing roller 13 and the ink on the developing roller 13, it is possible to control the supply of ink to be equally spread in a regular thickness on the developing roller 13.

According to the developing apparatus for the liquid type printer of the present invention as set forth above, it is possible to regularly supply the ink with high density to the photosensitive medium through the developing roller with the above-described structure. Therefore, a small and light-weight printer may be used and manufactured, and provide a user with a high-quality image.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A developing apparatus for a liquid type printer, comprising:

an ink supplying unit to supply ink having a high density;

a developing tank to receive the ink up to a predetermined level;

a developing roller positioned to rotate in the developing tank and keep a predetermined developing gap from a photosensitive medium, and to supply the ink to the photosensitive medium;

a metering unit having a predetermined electric potential applied thereto and rotated in the ink in the developing tank to control an amount of the ink conveyed to the developing roller and moved to the developing gap; and a cleaning roller to clean the ink remaining after the ink is conveyed from the developing roller to the photosensitive medium.

2. The developing apparatus according to claim 1, wherein the metering unit comprises:

a metering roller positioned to rotate in the developing tank, at a predetermined metering gap from the developing roller.

3. The developing apparatus according to claim 1, wherein the density of the ink received in the developing tank is 6–18%.

4. The developing apparatus according to claim 2, wherein the cleaning roller is rotated in the same direction as the developing roller, while being connected to the developing roller, to pump up the ink in the developing tank to a portion between the developing roller and the metering unit.

5. The developing apparatus according to claim 4, wherein the cleaning roller comprises:

a sponge including micro cells below 50 $\mu$m.

6. The developing apparatus according to claim 2, further comprising:

an ink conveying roller positioned to rotate in the developing tank to convey the ink to a side of the cleaning roller, so that the ink is smoothly supplied to the metering gap between the metering roller and the developing roller and equally spread per unit area on a circumference of the developing roller.

7. The developing apparatus according to claim 1, wherein the cleaning roller is formed with conductive materials to receive an applied voltage from a predetermined electric power source, to improve the supply of ink to the developing roller.

8. The developing apparatus according to claim 1, wherein the metering unit comprises:

a friction plate, elastically connected to the developing roller and elastically stressed by a rotational force of the developing roller and the ink, to control an amount of the ink to be regularly supplied to the developing roller.

9. The developing apparatus according to claim 1, wherein the developing roller pumps up the ink by a rotational force thereof, so that the ink is supplied to the photosensitive medium.

10. The developing apparatus according to claim 1, wherein the ink conveyed from the developing roller is transferred to an electrostatic latent image area of the photosensitive medium by a potential difference between the electrostatic latent image area formed on the photosensitive medium and the developing roller.

11. The developing apparatus according to claim 2, wherein the metering roller controls an amount of the ink conveyed to a circumference of the developing roller so that the ink is supplied in a predetermined amount to the developing gap between the developing roller and the photosensitive medium.

12. The developing apparatus according to claim 11, wherein the metering roller controls the amount of the ink on the developing roller to be 150–200 $\mu cm^2$.

13. The developing apparatus according to claim 4, wherein the cleaning roller is connected to a lower side of the developing roller and positioned in close proximity to the metering roller to pump up the ink to the metering gap between the metering roller and the developing roller by a rotational force thereof.

14. The developing apparatus according to claim 4, wherein the cleaning roller is positioned in close proximity to the metering roller to smoothly supply the ink to the developing roller so that the ink with the high density is equally spread on the developing roller.

15. A developing apparatus for a liquid type printer having a photosensitive medium and including an ink supplying unit to supply ink with a high density to a developing tank which receives the ink up to a predetermined level, the developing apparatus comprising:

a developing roller positioned to rotate in the developing tank and keep a predetermined developing gap from the photosensitive medium of the developing apparatus, and to supply the ink to the photosensitive medium;

a metering roller to control an amount of the ink conveyed to a circumference of the developing roller so that the ink is supplied in a predetermined amount to the developing gap between the developing roller and the photosensitive medium;

a cleaning roller to dean the ink remaining after the ink is conveyed from the developing roller to the photosensitive medium; and an ink conveying roller positioned to rotate in the developing tank to convey the ink to a side of the cleaning roller, so that the ink is smoothly supplied to a metering gap between the metering roller and the developing roller and equally spread per unit area on a circumference of the developing roller.

16. A developing apparatus for a liquid type printer having a photosensitive medium and including an ink supplying unit to supply ink with a high density to a developing tank which receives the ink up to a predetermined level, the developing apparatus comprising:

a developing roller positioned to rotate in the developing tank and keep a predetermined developing gap from the photosensitive medium of the developing apparatus, and to supply the ink to the photosensitive medium;

a friction plate, elastically connected to the developing roller and elastically stressed by a rotational force of the developing roller and the ink, to control an amount of the ink to be regularly supplied at a predetermined amount to the developing roller;

a cleaning roller to clean the ink remaining after the ink is conveyed from the developing roller to the photosensitive medium; and an ink conveying roller positioned to rotate in the developing tank to convey the ink to a side of the cleaning roller, so that the ink is smoothly supplied to a metering gap between the metering roller and the developing roller and equally spread per unit area on a circumference of the developing roller.

* * * * *